United States Patent [19]

Klassen

[11] 4,104,565

[45] Aug. 1, 1978

[54] LAMP SOCKET FOR USE WITH MULTI-LEVEL BULB AND NIGHTLIGHT

[76] Inventor: Fritz E. Klassen, 4860 McKinnon Dr., Anaheim, Calif. 92807

[21] Appl. No.: 798,756

[22] Filed: May 20, 1977

[51] Int. Cl.[2] ..... H05B 35/00; H01R 19/54

[52] U.S. Cl. ..... 315/178; 200/51.06; 200/51.17; 315/317

[58] Field of Search ..... 200/51.05, 51.06, 51.17; 315/67, 68, 178, 191, 313, 316, 317

[56] References Cited

U.S. PATENT DOCUMENTS

| | | | |
|---|---|---|---|
| 486,334 | 11/1892 | Hall et al. | 315/317 |
| 1,022,058 | 4/1912 | Bliss | 315/191 X |
| 1,147,949 | 7/1915 | Keen | 315/193 |
| 1,188,220 | 6/1916 | Tamura | 200/51.05 |

*Primary Examiner*—Alfred E. Smith
*Assistant Examiner*—Charles F. Roberts
*Attorney, Agent, or Firm*—Fraser and Bogucki

[57] ABSTRACT

A lamp socket for use with a three-way bulb and a nightlight has five positions including off, nightlight, nightlight and low, nightlight and medium, and high. The socket includes a screw base for receiving the three-way bulb, a nightlight terminal coupled to the nightlight located outside of and remote from the socket, and a pair of power terminals coupled via wires and a plug to a wall outlet or other source of power. The different combinations and levels of illumination are provided by a rotatable element within the socket coupled to be rotated by a turnkey and having opposite conductive shells forming a predetermined array of conductive and non-conductive segments at pairs of inclined teeth at the outer edge of the element. One of the power terminals is electrically coupled to one of the conductive shells by a flexible contact. The nightlight terminal and a pair of contacts at the base of the three-way bulb are coupled to resilient contacts disposed in fixed locations so as to contact the various conductive and non-conductive segments on the pairs of inclined teeth as the element is rotated. The conductive shells are selectively coupled to and uncoupled from one another when the element is in the different positions by a further pair of resilient contacts disposed to contact different pairs of the inclined teeth as the element is rotated.

10 Claims, 9 Drawing Figures

Fig. 1
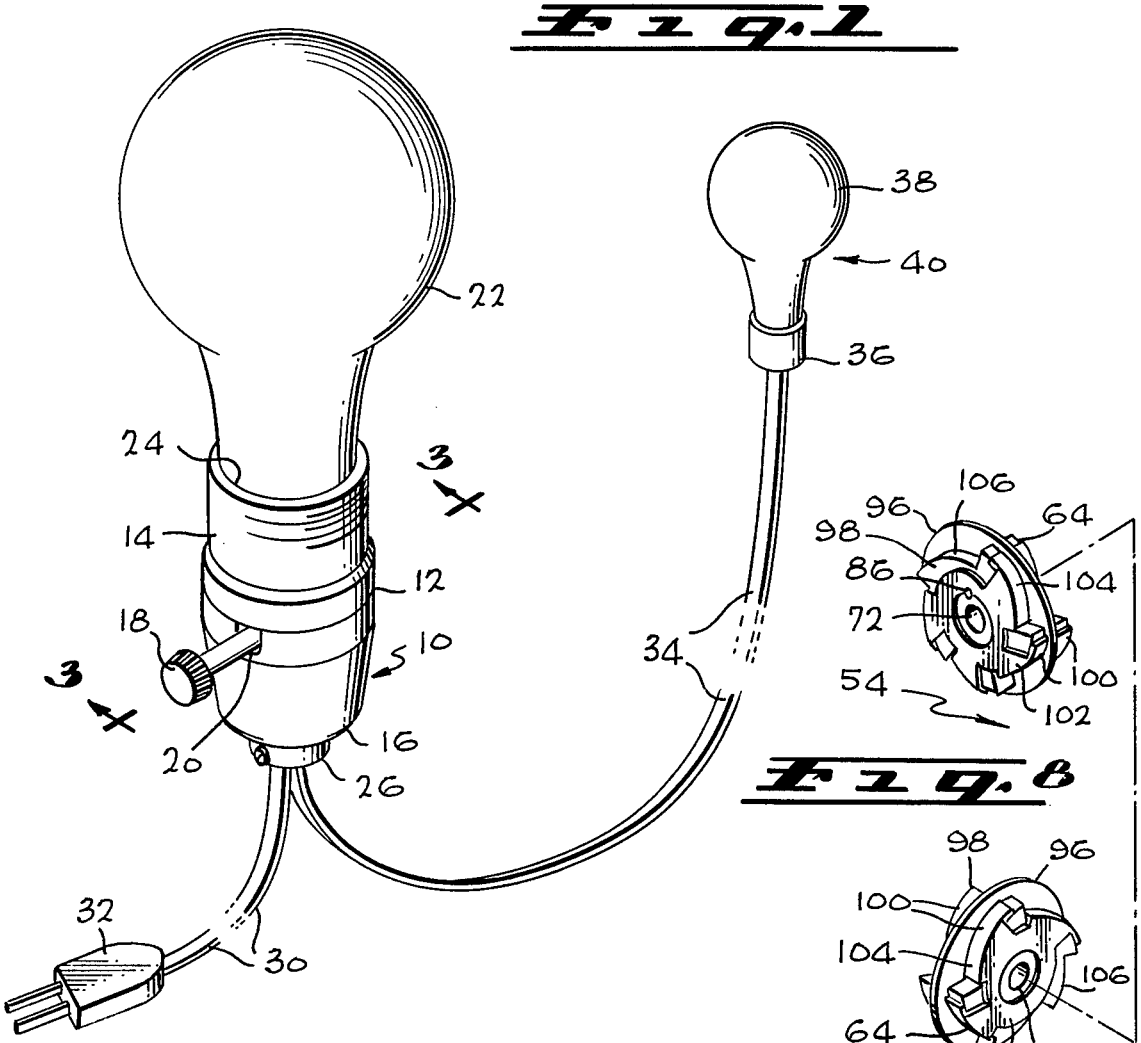
Fig. 8
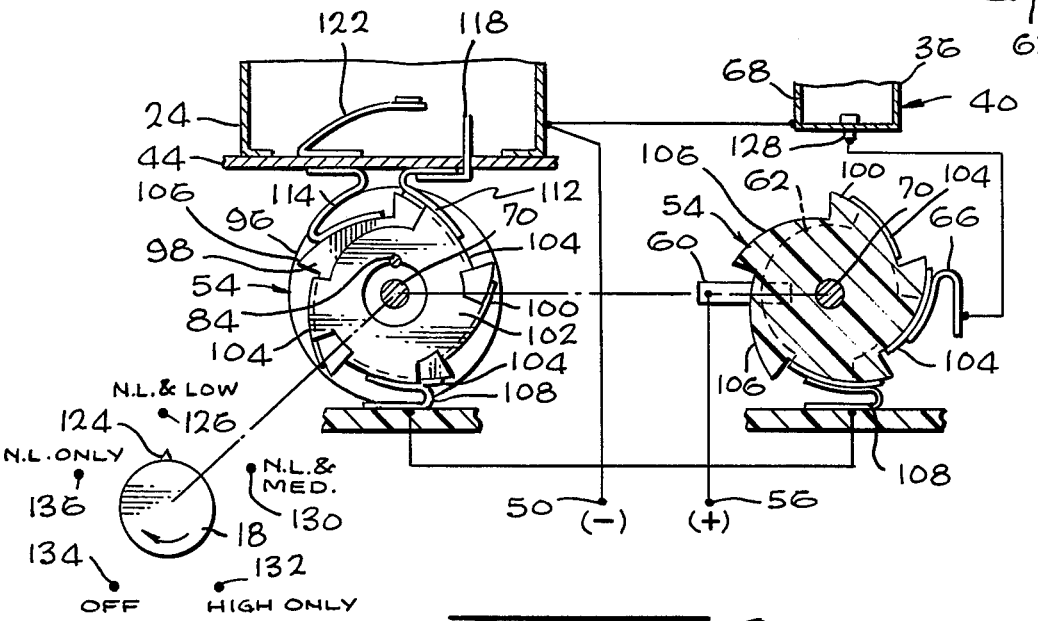
Fig. 9

14
24
10
100
86
96
72
98
62
64
54
122
120
44
114
116
112
102
56
60
108
66
58
90
88
74
52
92
42
94
50
76
84
70
70
80
78
82
18
20
16
26

26
58
42
50
46
18
110
16
56
48

Fig. 3
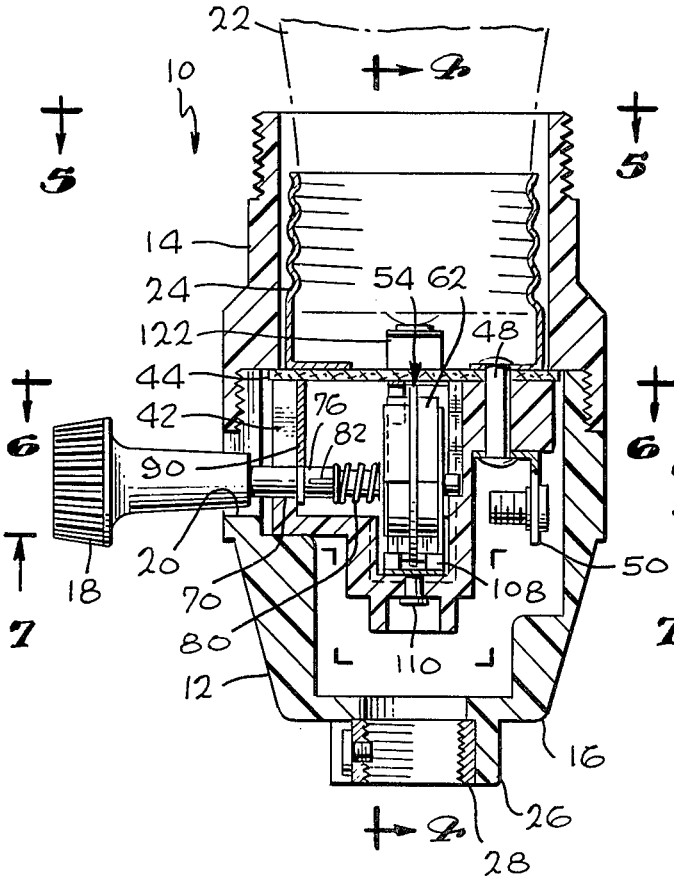
Fig. 4
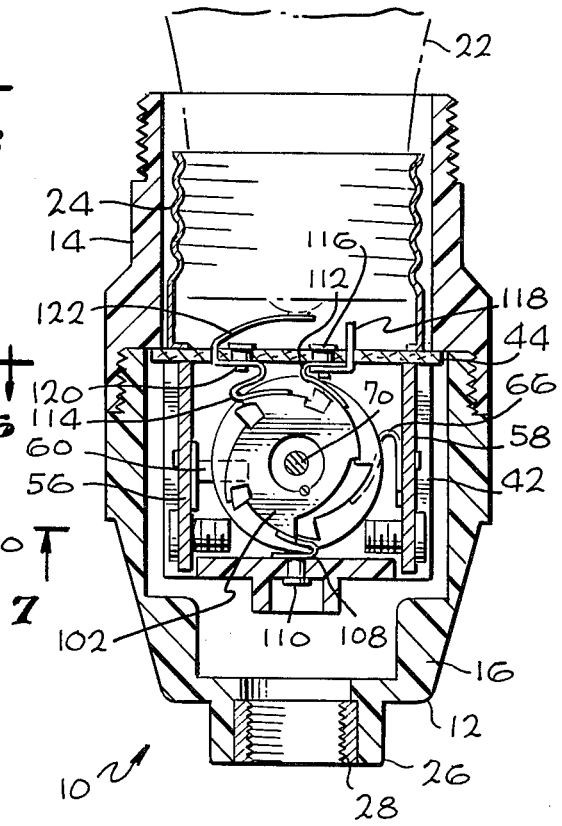
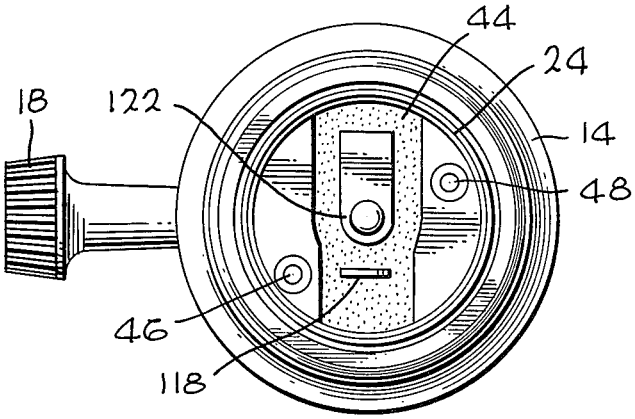
Fig. 5
Fig. 6
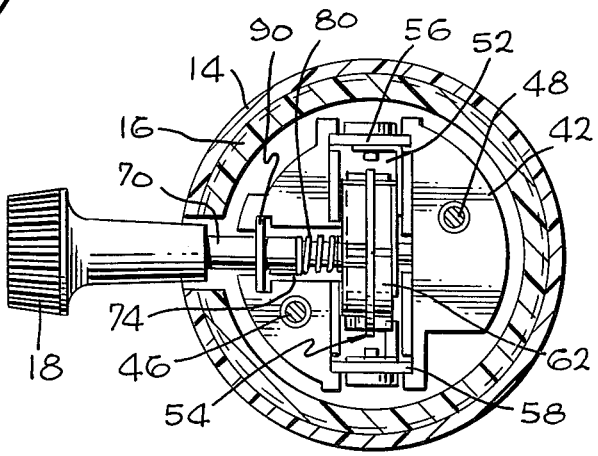

LAMP SOCKET FOR USE WITH MULTI-LEVEL BULB AND NIGHTLIGHT

BACKGROUND OF THE INVENTION

1. Field of the Invention

The present invention relates to multi-position lamp sockets for use with one or more bulbs having one or more levels of illumination.

2. History of the Prior Art

It is known to provide lamp sockets to control the illumination of a light bulb by manually moving a turnkey or similar control into different positions. For example, in the case of sockets used with three-way bulbs, the sockets are provided with appropriate apparatus for energizing one, then the other, and then both of a pair of contacts at the base of the bulb so as to provide low, medium and high levels of illumination in addition to an off position. In still other types of socket arrangements, the sockets make use of various electrical components and devices to provide multiple levels of illumination from a one-way bulb. Examples of the latter type of lamp socket are provided by U.S. Pat. No. 3,028,523, 3,028,525, 3,496,451, 3,543,088, 3,517,259, 3,452,215, 3,372,302 and 3,450,941.

It is also known to provide a lamp socket for use with both a main bulb screwed into the socket and an auxiliary bulb such as a nightlight located outside of the socket. Such arrangements are commonly used in the case of table lamps which locate the socket and included main bulb at the top thereof within the shade and which locate a nightlight at or within the base thereof. Such sockets are capable of turning on the main bulb and the nightlight individually as well as together.

However, heretofore it has not been known to provide a lamp socket capable of use with both a nightlight and a main bulb having multiple levels of illumination such that the nightlight and the main bulb can be illuminated both by themselves and in combination with one another at various levels of illumination of the main bulb. In particular, it would be highly advantageous to provide a lamp socket capable of four different positions in addition to the off position whereby the nightlight can be illuminated alone and in combination with either the low or medium levels of illumination of the main bulb and wherein the high level of illumination of the main bulb can be provided without the nightlight.

BRIEF SUMMARY OF THE INVENTION

Lamp sockets in accordance with the invention control a three-way bulb in combination with a nightlight and include a turnkey-rotated element movable into five different positions to provide off, nightlight only, nightlight and low, nightlight and medium, and high only conbinations. The rotatable element has an opposite pair of conductive shells mounted thereon and extending into the regions of some but not all of five different pair of inclined teeth at the outer periphery thereof so as to form conductive segments on some but not all of the teeth. One of the conductive shells is constantly energized by being coupled via a contact to one of a pair of power terminals located within the socket and adapted to be coupled to a source of power. The continuously energized conductive shell is selectively coupled to and uncoupled to a source of power. The continuously energized conductive shell is selectively coupled to and uncoupled from the other shell as the element is rotated by the turnkey into each of the five different positions by a pair of contacts coupled to one another and disposed adjacent opposite ones of each pair of teeth at the outer periphery of the element. Other flexible contacts are disposed at different locations around the rotatable element so as to contact different ones of the pairs of teeth as the element is rotated into the different positions. These contacts are coupled to the nightlight via an auxiliary or nightlight terminal within the socket and to the two different lamp contacts at the base of the three-way bulb. As the rotatable element is rotated the flexible contacts engage different combinations of the conductive and non-conductive segments formed by the pair of conductive shells at the pairs of inclined teeth so as to effect the desired interconnections for the five different positions of the socket.

BRIEF DESCRIPTION OF DRAWINGS

The foregoing and other objects, features and advantages of the invention will be apparent from the following more particular description of preferred embodiments of the invention, as illustrated in the accompanying drawings, in which:

FIG. 3 is a sectional view of the socket of FIG. 1 taken along the lines 3—3 thereof;

FIG. 4 is a sectional view of the socket of FIG. 3 taken along the lines 4—4 thereof;

FIG. 5 is a top view of the socket of FIG. 3 viewed from the line 5—5 thereof;

FIG. 6 is a sectional view of the socket of FIG. 3 taken along the line 6—6 thereof;

FIG. 7 is a sectional view of the socket of FIG. 3 taken along the line 7—7 thereof;

FIG. 8 is a dual perspective view of the rotatable element of the socket of FIG. 1 showing the details of the opposite sides and their relative orientation; and FIG. 9 is a combined plan view of portions of the socket of FIG. 1 and an electrical schematic diagram showing the interconnections of the various contacts of the socket.

DETAILED DESCRIPTION

Figures 1, 2:
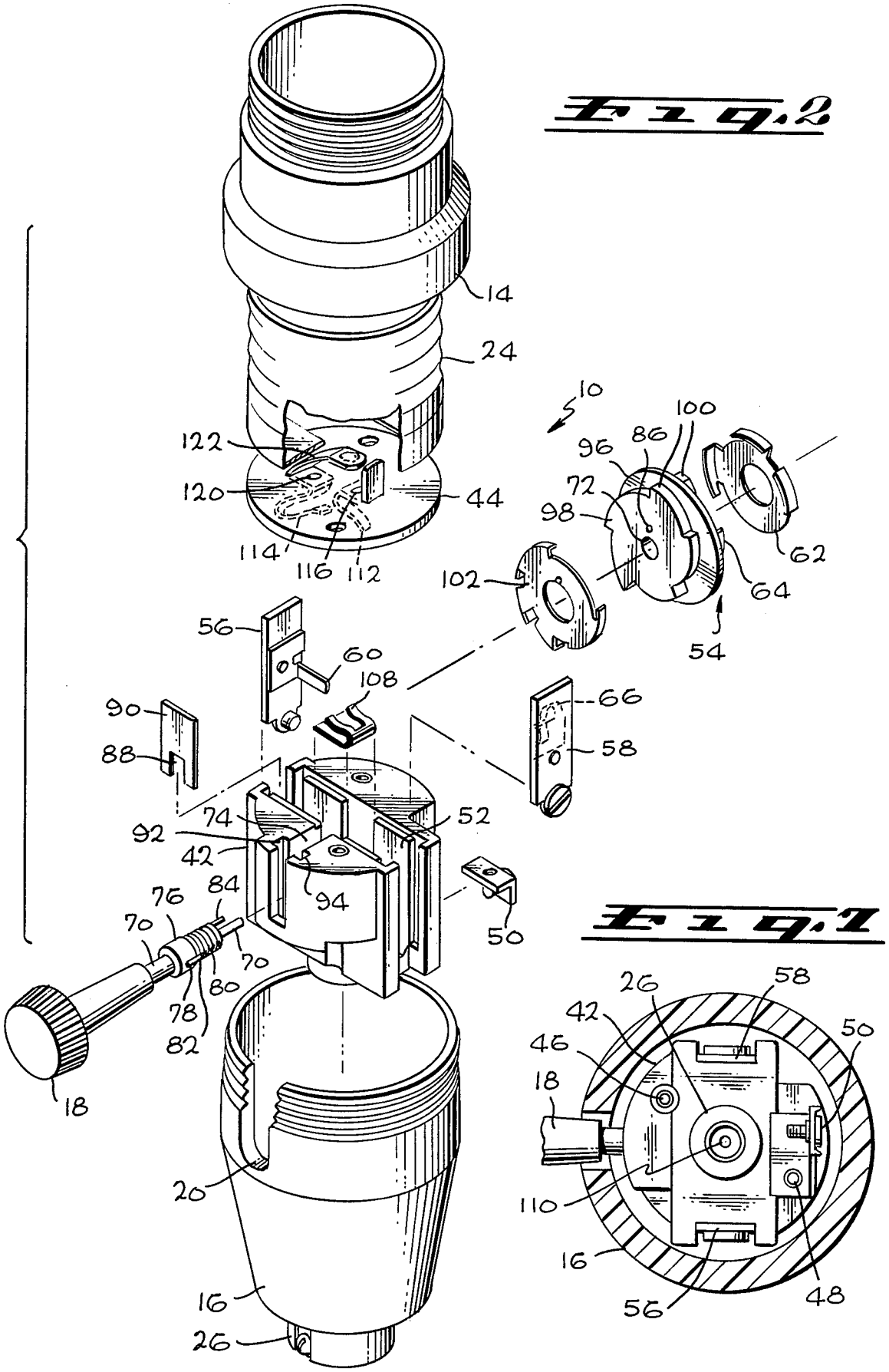
FIG. 1 is a perspective view of a five-way lamp socket in accordance with the invention having a three-way bulb mounted therein and coupled to a nightlight.
FIG. 2 is an exploded perspective view of the socket of FIG. 1.

FIG. 1 depicts a lamp socket 10 in accordance with the invention. The socket 10 has an outer housing 12 comprised of an upper shell 14 into which is screwed a lower cap 16. The shell 14 and the cap 16 are made of phenolic or similar materials. A turnkey 18 extends through an aperture 20 in the cap 16 to the interior of the housing 12. As described in detail hereafter, manual rotation of the turnkey 18 provides the five different positions of the socket 10.

A three-way bulb 22 is received within a mating screw-base 24 mounted within the shell 14. The lower portion of the cap 16 terminates in a collar 26. As shown in FIGS. 3 and 4 the collar 26 has a threaded insert 28 therein so as to facilitate mounting of the socket 10 on the threaded shaft at the top of a lamp base in conventional fashion. A two-wire cord 30 is shown in FIG. 1 as extending out of the socket 10 via the collar 26 and terminating in a plug 32. With the socket 10 mounted on a lamp, the cord 30 normally extends down through the exits from the base of the lamp. The plug 32 is inserted in a conventional wall receptacle or other source of power to provide electrical power to the socket 10.

A second two-wire cord 34 exits from the collar 26 at the bottom of the socket 10 and is coupled to a socket 36 which receives a one-way bulb 38 forming an auxiliary bulb or nightlight 40. With the socket 10 installed on a lamp, the cord 34 is typically completely contained within the base of the lamp where the nightlight 40 is mounted. In such arrangements portions of the lamp base are typically made of transparent or translucent material so that the nightlight can be seen outside of the lamp.

The turnkey 18 is rotatable in a single direction through five different positions, the first of which is an off position in which neither of the bulbs 22 and 38 is illuminated. In the second position only the bulb 38 of the nightlight 40 is illuminated. In the third position the bulb 22 is illuminated at its low level of intensity in combination with the bulb 38. In the fourth position the bulb 22 is illuminated at its medium level of intensity in combination with the bulb 38. In the fifth position the bulb 22 is illuminated at its high level to the exclusion of the bulb 38.

A body 42 of generally cylindrical shape and of phenolic or similar composition is disposed within the hollow interior of the housing 12 formed by the shell 14 and the cap 16. The screwbase 24 which is disposed within the hollow interior of the shell 14 at the upper part of the socket 10 is disposed on an insulating disk 44 on top of the body 42 and is secured to the body 42 by a pair of rivets 46 and 48. The end of the rivet 48 opposite the screwbase 24 also mounts a power terminal 50 on the body 42. The rivet 48 is of conductive material so as to electrically couple the power terminal 50 to the screwbase 24.

The body 42 is provided with a slot 52 in the central region thereof for receiving a disk-shaped element 54 and an opposite pair of terminals 56 and 58. The terminal 56 forms a second power terminal, and the terminal 58 forms an auxiliary or nightlight terminal. Mounted on the power terminal 56 at the inside of the slot 52 is a resilient contact 60 which continually bears against the surface of a conductive shell 62 disposed on a disk-shaped outer portion 64 of the element 54. One of the wires of the two-wire cord 30 is coupled to the power terminal 50 while the other wire is coupled to the power terminal 56. One of the wires of the two-wire cord 34 to the nightlight 40 is coupled to the power terminal 50 and the other wire is coupled to the nightlight terminal 58. A resilient contact 66 mounted on the nightlight terminal 58 is disposed adjacent the outer periphery of the conductive shell 62. In this manner power from a wall outlet or other power source is applied to the power terminals 50 and 56. As shown in FIG. 9 the power terminal 50 is coupled to the screwbase 24 of the main or three-way bulb 22 as well as to a screw base 68 within the socket 36 of the nightlight 40. The other power terminal 56 couples the source of power continuously to the conductive shell 62 via the resilient contact 60. The nightlight 40 is coupled to the source of power via the power terminal 50 and the resilient contact 66 mounted on the nightlight terminal 58 and which contacts the conductive shell 62 during some but not all of the different positions of the disk-shaped element 54.

The disk-shaped element 54 is mounted for rotation within the slot 52 by a shaft 70 extending from the turnkey 18 and disposed within a central aperture 72 in the element 54. The shaft 70 which is disposed within a slot 74 in the body 42 disposed orthogonally to and connecting with the slot 52 has a raised collar 76 having a groove 78 therein. A coil spring 80 disposed on the shaft 70 has a first end 82 thereof disposed within the groove 78 and an opposite second end 84 thereof disposed within a small aperture 86 within the disk-shaped element 54 adjacent the central aperture 72.

The spring 80 thereby couples the shaft 70 and the included turnkey 18 to the disk-shaped element 54 so that the element 54 turns with manual rotation of the turnkey 18. At the same time the spring 80 provides a desirable resiliency in such coupling in addition to providing a resiliency which seats the element 54 securely within the slot 52. The shaft 70 is held in place against the urging of the spring 80 by a slot 88 in the lower end of an elongated washer 90 which is journaled within grooves 92 and 94 in the opposite sides walls of the slot 74 and which bears against the raised collar 76 of the shaft 70.

The disk-shaped element 54 has a disk-shaped central portion 96 separating the disk-shaped outer portion 64 from an opposite disk-shaped outer portion 98 of like shape and size. The generally disk-shaped outer portions 64 and 98 which are concentric with and of smaller diameter than the separating central portion 96 have outer edges on opposite sides of the central portion 96 which form five different pairs of inclined teeth 100. A conductive shell 102 having a shape similar to the conductive shell 62 is disposed over the disk-shaped outer portion 98. The conductive shell 102 extends out to and over four of the five inclined teeth 100 at the outer edge of the disk-shaped outer portion 98 to form four different conductive segments 104. The remaining inclined tooth which is not covered by the conductive shell 102 defines a non-conductive segment 106. The opposite conductive shell 62 extends over three of the five inclined teeth 100 at the outer edge of the disk-shaped outer portion 64 to define three conductive segments and two non-conductive segments.

As the disk-shaped element 54 is rotated by the turnkey 18, the various conductive and non-conductive segments come in contact with different ones of a plurality of resilient contacts to effect the desired interconnections between the power terminals 50 and 56 and the bulbs 22 and 38. The resilient contacts include the contact 66 mounted on the power terminal 58, a split contact 108 secured at the bottom of the slot 52 by a rivet 110, and a pair of resilient contacts 112 and 114 mounted on the insulating disk 44. A rivet 116 which mounts the resilient contact 112 to the disk 44 also couples the contact 112 to a contact 118 disposed at the base of the screwbase 24 in a position so as to contact the "low" conductive band of the three-way bulb 22. The resilient contact 114 is mounted on the disk 44 by a rivet 120 which also couples the contact 114 to a contact 122 disposed at the base of the screwbase 24 so as to contact the center or "medium" conductive portion of the three-way bulb 22. In this manner the resilient contact 112 is coupled to the "low" filament of the three-way bulb 22, and the resilient contact 114 is coupled to the "medium" filament of the three-way bulb 22.

It will be observed that the five different pairs of inclined teeth 100 of the disk-shaped element 54 define five different stations around the outer periphery of the element 54. The resilient contacts 114, 112, 66 and 108 are disposed at different ones of four of the five stations. The resilient contacts 114 and 112 are disposed in the path of the disk-shaped outer portion 98 and its included conductive shell 102. The resilient contact 66 is disposed in the path of the disk-shaped outer portion 64 and included conductive shell 62. The split contact 108 is disposed in the path of both of the disk-shaped outer portions 64 and 98 and serves to electrically coupled the conductive shell 62 to the conductive shell 102 when conductive segments 104 from both the portions 64 and the portion 98 are simultaneously present at the station occupied by the contact 108.

FIG. 9 shows both sides of the disk-shaped element 54 when disposed in one of the five different positions by the turnkey 18. For purposes of reference, the turnkey 18 is shown positioned such that a pointer 124 thereon points to a third position 126. In this position the continuously energized conductive shell 62 contacts the resilient contact 66 which in turn is coupled to a contact 128 at the base of the screwbase 68 to illuminate the nightlight bulb 38. At the same time the split contact 108 contacts both of the conductive shells 62 and 102. The conductive shell 102 contacts the resilient contact 112 but not the resilient contact 114. Consequently the three-way bulb 22 is illuminated at its low level.

If the turnkey 18 is rotated clockwise as seen in FIG. 9 so as to advance the disk-shaped element 54 to a fourth position 130, the resilient contact 66 continues to contact the conductive shell 62 to maintain the nightlight 40 illuminated. The conductive shell 102 contacts the resilient contact 114 but not the resilient contact 112, and the three-way bulb 22 is illuminated at its medium level of intensity.

If the turnkey 18 is rotated clockwise so as to rotate the element 54 into the next position identified as a fifth position 132, the contact between the resilient contact 66 and the conductive shell 62 is broken, and the nightlight 40 goes out. At the same time the conductive shell 102 is coupled to both the resilient contacts 112 and 114, and the three-way bulb 33 is illuminated at its high level of intensity.

If the turnkey 18 is now rotated to the next or first position 134, contact between the resilient contact 66 and the conductive shell 62 is still broken, and the nightlight 40 remains out. At the same time the split contact 108 rests against a non-conductive segment of the disk-shaped outer portion 64 so as to uncouple the conductive shell 62 from the conductive shell 102 and thereby turn off the three-way bulb 22.

If the turnkey 18 is now rotated into a second position 136, the conductive shell 62 is coupled to the resilient contact 66 to illuminate the nightlight 40. At the same time the conductive shell 62 remains uncoupled from the split contact 108, and the three-way bulb 22 remains out.

If the turnkey 18 is now turned one more time so as to move the element 54 into the third position 126 which is illustrated in FIG. 9, the conductive shell 62 remains in contact with the resilient contact 66 to keep the nightlight 40 illuminated. At the same time the condustive shell 62 is coupled to the conductive shell 102 via the split contact 108, and the conductive shell 102 is in turn coupled to the resilient contact 112 to illuminate the three-way bulb 22 at the low level.

The inclined configuration of the teeth 100 together with the various resilient contacts 66, 108, 112 and 114 insures that only one-way rotation of the element 54 which is the clockwise direction as shown in FIG. 9 is possible.

While the invention has been particularly shown and described with reference to a preferred embodiment thereof, it will be understood by those skilled in the art that various changes in form and details may be made therein without departing from the spirit and scope of the invention.

What is claimed is:

1. A socket for use with a main bulb having at least two different levels of illumination and an auxiliary bulb, the socket comprising a housing, a plurality of power terminals within the housing adapted to be coupled to a source of power, a plurality of main terminals within the housing adapted to be coupled to a main bulb having at least two different levels of illumination, at least one auxiliary terminal within the housing adapted to be coupled to an auxiliary bulb, and manually actuable means coupled to the power terminals, the main terminals and the at least one auxiliary terminal and operative to couple the power terminals to different combinations of the main terminals, the at least one auxiliary terminal, and both the main terminals and the at least one auxiliary terminal as the manually actuable means is manually advanced through a plurality of different positions.

2. The invention set forth in claim 1, wherein the main terminals include at least two terminals, each of which is operative to provide a different one of the at least two different levels of illumination of a main bulb when coupled to the power terminals, and the manually actuable means is operative to couple the power terminals to both the at least one auxiliary terminal and one of the at least two terminals of the main terminals when in a first one of the plurality of different positions and to the other one of the at least two terminals of the main terminals to the exclusion of the at least one auxiliary terminal when in a second one of the plurality of different positions.

3. The invention set forth in claim 1, wherein the main terminals are arranged to provide low, medium and high illumination levels of a main bulb and the manually actuable means is operative to provide off, auxiliary bulb only, auxiliary bulb plus low main bulb, auxiliary bulb plus medium main bulb, and high main bulb only, conditions of illumination as the manually actuable means is manually advanced through the different positions.

4. A lighting arrangement comprising a socket having a bulb-receiving opening therein, a three-way bulb mounted in the bulb-receiving opening, a nightlight coupled to the socket, means adapted to couple a source of power to the socket and means within the socket for applying power in the socket to the three-way bulb and the nightlight in a plurality of different combinations wherein the means for applying the power is operative to apply power exclusively to the nightlight in one combination, exclusively to the three-way bulb in another combination and to both the nightlight and the three-way bulb in at least two other combinations in which the levels of illumination of the three-way bulb are different.

5. The invention set forth in claim 4, wherein the means for applying the power includes a plurality of contacts coupled to the three-way bulb, the nightlight and the means adapted to be coupled to a source of power, a single element rotatable into different positions, and at least one conductive member mounted on the single element and operative to make contact between different combinations of the contacts as the single element is rotated into the different positions.

6. The invention set forth in claim 5, wherein the single element has an opposite pair of sides with the at least one conductive member mounted on one of the pair of sides, and further including a second conductive member mounted on the other one of the pair of sides, and means for electrically coupling the first-mentioned conductive member to the second conductive member when the single element is in some but not all of the different positions.

7. A socket comprising the combination of a housing, a screwbase mounted on the housing, first and second power terminals mounted on the housing, conductive means coupling the second power terminal to the screwbase, first and second lamp contacts mounted within the screwbase, an auxiliary light terminal mounted on the housing, a manually rotatable element mounted on the housing, conductive means mounted on the manually rotatable element and defining a predetermined array of conductive and nonconductive segments at the outer periphery of the rotatable element, a power contact mounted on the housing and coupling the first power terminal to the conductive means, and a plurality of contacts mounted on the housing and disposed in spaced-apart relation about the outer periphery of the rotatable element and each being coupled to a different one of the first and second lamp contacts and the auxiliary light terminal.

8. The invention set forth in claim 7, wherein the manually rotatable element comprises a generally disc-shaped element mounted for rotation about a central axis thereof and having an outer edge divided into a plurality of different contact portions and a manually operable key coupled to the disc-shaped element and extending outside of the housing, and the conductive and non-conductive segments reside at the different contact portions of the disc-shaped element.

9. The invention set forth in claim 8, wherein the conductive means comprises a pair of conductive shells mounted on opposite sides of the disk-shaped element and each extending into selected ones of the different contact portions to define conductive segments, the power contact contacts one of the pair of conductive shells, and further including a pair of contacts mounted on the housing adjacent different ones of the conductive shells and coupled to each other.

10. A socket comprising the combination of a hollow housing, a screwbase mounted within the housing, an element rotatably mounted within the housing and having a disc-shaped central portion and first and second like disc-shaped outer portions on opposite sides of the central portion, each of the first and second outer portions being generally concentric with and having a smaller diameter than the central portion and an outer edge which is divided into five inclined teeth which are aligned with the five inclined teeth of the other outer portion to define five different pairs of inclined teeth around the outer edge of the rotatable element, first and second conductive shells configured in the general shape of and disposed over parts of the first and second outer portions respectively of the rotatable element, the first conductive shell extending over four of the five inclined teeth of the first outer portion and the second conductive shall extending over three of the five inclined teeth of the second outer portion opposite three of the four inclined teeth of the opposite first outer portion over which the first conductive shell extends, a pair of power terminals and a night light terminal mounted within the housing, a first one of the pair of power terminals being coupled to the screw base, a pair of lamp contacts mounted within the screwbase, a power contact coupled to the second one of the pair of power terminals and disposed to maintain continuous contact with the second conductive shell, first and second resilient contacts mounted within the housing and disposed in contact with the opposite teeth of a first one of the five different pairs of inclined teeth, the first and second resilient contacts being coupled to each other, a third resilient contact mounted within the housing and disposed in contact with the inclined tooth of the first outer portion at a third one of the five different pairs of inclined teeth, the third resilient contact being coupled to a first one of the pair of lamp contacts, a fourth resilient contact mounted within the housing and disposed in contact with the inclined tooth of the first outer portion at a fourth one of the five different pairs of inclined teeth, the fourth resilient contact being coupled to the second one of the pair of lamp contacts, and a fifth resilient contact mounted within the housing and disposed in contact with the inclined tooth of the second outer portion at a fifth one of the five different pairs of inclined teeth.

* * * * *